US011713570B1

(12) United States Patent
Rodriguez

(10) Patent No.: US 11,713,570 B1
(45) Date of Patent: Aug. 1, 2023

(54) MEMBER TO STRUCTURAL MEMBER CONNECTOR

(71) Applicant: Ileana Rodriguez, Miami, FL (US)

(72) Inventor: Ileana Rodriguez, Miami, FL (US)

( * ) Notice: Subject to any disclaimer, the term of this patent is extended or adjusted under 35 U.S.C. 154(b) by 0 days.

(21) Appl. No.: 17/476,831

(22) Filed: Sep. 16, 2021

(51) Int. Cl.
*E04B 1/38* (2006.01)
*E04D 13/00* (2006.01)
*E04B 1/41* (2006.01)
*E04B 7/02* (2006.01)

(52) U.S. Cl.
CPC ..... *E04B 1/40* (2013.01); *E04B 7/022* (2013.01); *E04B 2001/405* (2013.01)

(58) Field of Classification Search
CPC ..... E04B 1/40; E04B 7/022; E04B 2001/405
USPC ..... 52/92
See application file for complete search history.

(56) References Cited

U.S. PATENT DOCUMENTS 1,199,077 A * 9/1916 James ..... E04G 17/14 52/699
1,406,723 A 2/1922 Caldwell
1,578,947 A 4/1926 Alber
1,648,724 A * 11/1927 Dakin ..... E04G 21/28 135/900
3,091,822 A * 6/1963 Fiekers ..... E04B 1/2608 403/394
3,184,800 A * 5/1965 Nelson ..... E04B 1/2608 403/402
3,782,058 A * 1/1974 Allen ..... E04B 1/41 52/712
3,889,441 A 6/1975 Fortine
4,022,537 A 5/1977 Gilb et al.
4,249,713 A * 2/1981 Glynn ..... A62B 35/04 248/237
4,422,279 A * 12/1983 Powell ..... E04B 1/0007 52/745.12
4,527,375 A * 7/1985 Braginetz ..... E04B 1/2608 52/712
4,602,468 A 7/1986 Simpson
4,756,133 A * 7/1988 Madray ..... E04C 3/09 52/127.2
4,841,690 A 6/1989 Commins
5,109,646 A 5/1992 Colonias et al.
5,257,483 A * 11/1993 Netek ..... E04B 7/02 52/93.2
5,335,470 A * 8/1994 Alvarez ..... E04B 7/04 52/92.2

(Continued)

*Primary Examiner* — Brian E Glessner
*Assistant Examiner* — James J Buckle, Jr.
(74) *Attorney, Agent, or Firm* — Albert Bordas, P.A.

(57) ABSTRACT

A member to structural member connector, having a strap assembly with first and second lateral sides, and a top side; and a fastening assembly, wherein the strap assembly secures at least one member to a fixed structure, wherein the strap assembly wraps over the at least one member and the first and second lateral sides are fixed to the fixed structure by the fastening assembly. The first lateral side has a first top edge and a first bottom end. The second lateral side has a second top edge and a second bottom end. The first lateral side has a first hole that is a first predetermined distance from the first bottom end. The second lateral side has a second hole that is a second predetermined distance from the second bottom end. The top side is in between the first and second top edges.

7 Claims, 2 Drawing Sheets

(56) References Cited

U.S. PATENT DOCUMENTS 5,361,558 A * 11/1994 Thornton ..... E04D 13/12 52/27
5,390,460 A * 2/1995 Llorens ..... E04D 3/3605 52/489.1
5,402,616 A * 4/1995 Klein ..... B28B 23/0056 52/578
5,448,871 A 9/1995 Newman et al.
5,560,156 A 10/1996 McDonald
5,603,580 A 2/1997 Leek et al.
5,699,639 A 12/1997 Fernandez
5,896,719 A * 4/1999 Thornton ..... E04G 5/041 52/27
6,185,897 B1 * 2/2001 Johnson ..... E04C 5/16 52/715
6,199,712 B1 * 3/2001 Rosset ..... B65D 90/042 220/4.16
6,254,051 B1 * 7/2001 Hubbard ..... F24H 9/06 24/280
6,254,052 B1 * 7/2001 Hubbard ..... F24H 9/06 248/225.11
6,772,570 B2 * 8/2004 Horne ..... E04B 7/06 52/715
7,124,550 B1 * 10/2006 Deming ..... E04B 1/4157 52/703
8,037,643 B1 * 10/2011 Anderson ..... E04D 12/008 248/237
8,522,501 B2 * 9/2013 King ..... E04B 5/023 52/125.4
8,696,399 B2 * 4/2014 Mimlitch ..... A63H 33/042 403/384
8,746,402 B2 * 6/2014 Nichols, Jr. ..... E04G 21/3276 248/237
9,441,371 B1 * 9/2016 Harkins ..... E04B 7/18
2011/0025013 A1 * 2/2011 Kuroda ..... F16F 1/16 280/124.152
2011/0094173 A1 * 4/2011 Parker ..... E04B 2/702 52/261
2022/0298777 A1 * 9/2022 Simpson ..... E04B 2/822

* cited by examiner

MEMBER TO STRUCTURAL MEMBER CONNECTOR

BACKGROUND OF THE INVENTION

1. Field of the Invention

The present invention relates to connectors for structural members, and more particularly, to member to structural member connectors.

2. Description of the Related Art

Applicant believes that one of the closest references corresponds to U.S. Pat. No. 3,091,822 A issued to Fiekers, et al. on Jun. 4, 1963 for Connector for structural members. However, it differs from the present invention because Fiekers, et al. teach a connector for structural members and more particularly to a wind brace for connecting a truss member to a structural plate.

Applicant believes that another reference corresponds to U.S. Pat. No. 5,448,871 A issued to Newman, et al. on Sep. 12, 1995 for Truss hold-down strap. However, it differs from the present invention because Newman, et al. teach a continuous narrow, elongated metal member bent to form a strap for holding down a truss, the strap having a saddle portion to fit over the truss and two arms diverging therefrom to lie flat against the plates upon which the truss is supported and adapted to be nailed or otherwise fastened to the plates.

Applicant believes that another reference corresponds to U.S. Pat. No. 3,889,441 A issued to Fortine on Jun. 17, 1975 for Mudsill tiedown. However, it differs from the present invention because Fortine teaches an anchor used in building construction to tie the mudsill to a concrete foundation. The device being constructed from an elongated sheet metal strip; cut and formed on a progressive die. The tiedown consists of an "arrowhead" shaped web, angularly related sides preventing withdrawal and depending tie members, which are dimensioned to overlap or overlie the wood mudsill. The tie members are formed with apertures so that nails or other fasteners can be easily inserted therethrough for securing the tie members to the mudsill.

Applicant believes that another reference corresponds to U.S. Pat. No. 5,699,639 A issued to Fernandez on Dec. 23, 1997 for Adjustable anchorage for trusses. However, it differs from the present invention because Fernandez teaches an anchorage device for keeping a truss in place with respect to a poured concrete body having an elongated housing including a longitudinal slot and anchorage members rigidly mounted to the elongated housing thereby permitting the anchorage device being anchored in the poured cement. The anchorage device also having a connecting plate assembly with a strap including several openings for fastening a truss to the plate assembly. A lifted spacer area with two slots or cuts allows the strap through. The plate assembly is slidably mounted along the slot for its proper positioning after the truss are positioned.

Applicant believes that another reference corresponds to U.S. Pat. No. 5,560,156 A issued to McDonald on Oct. 1, 1996 for Hurricane tie-down. However, it differs from the present invention because McDonald teaches an improved hurricane tie-down member is formed of a unitary flat metallic preform to restrain roof trusses experiencing high wind conditions by optimally transferring dynamic roof uplift forces from a planar saddle portion to a vertical wall via a pair of side arm members and flat anchor surfaces. In a preferred embodiment, over Kips of shear resistance is provided per tie-down member, and when used in sets of four tie-downs, a highly effective method for pitched roof protection.

Applicant believes that another reference corresponds to U.S. Pat. No. 5,109,646 A issued to Colonias, et al. on May 5, 1992 for Bearing connection. However, it differs from the present invention because Colonias, et al. teach a bearing connection in a building structure for distributing downward gravity bearing loads through fasteners driven through sheet metal connectors and into a load carrying wood structural member such as a floor joist, a roof rafter, or a wood truss member, through a pair of sheet metal connectors and into a wood plate member via fasteners driven through the connectors and into the plate member. Seismic, hurricane or other upward forces are also resisted by the same connectors and fasteners. Relative movement between the load carrying structural member and the plate member is also resisted in a generally horizontal direction transverse as well as parallel to the plate member.

Applicant believes that another reference corresponds to U.S. Pat. No. 4,022,537 A issued to Gilb, et al. on May 10, 1977 for Knee brace for glulam and heavy timber construction. However, it differs from the present invention because Gilb, et al. teach a knee brace to provide lateral resistance at the bottom of glued laminated beams and solid heavy timbers. The brace consists of an elongated strap connected at its mid point to the bottom of the glulam or heavy timber. Legs angled outwardly are connected at their ends to transverse members. Special cut sections in the strap provide tabs running perpendicular to the bottom of the braced glulam or timber. The tabs are held to the side faces of the braced member by nails. The bent tabs and nails in the bottom of the glulam provide the resistance to overturn loads.

Applicant believes that another reference corresponds to U.S. Pat. No. 4,841,690 A issued to Commins on Jun. 27, 1989 for Impact nailed connector. However, it differs from the present invention because Commins teaches a sheet metal connector for wood-to-wood, metal or concrete connections between holding and held members in a building structure in which all or substantially all of the nail openings in the connector are omitted and replaced by indicia inscribed, printed, or formed in the connector at or near the locations where the nail holes were formerly punched. Fasteners, such as nails may be driven through the indicia areas of the connector and into the held and holding members by automatic top fastenering guns or heavy hand held impact hammers.

Applicant believes that another reference corresponds to U.S. Pat. No. 5,603,580 A issued to Leek, et al. on Feb. 18, 1997 for Positive angle fastener device. However, it differs from the present invention because Leek, et al. teach a positive fastener-angling device for positioning an elongated fastener with respect to the face of a sheet metal connector and a wood member only at a preselected angle which is substantially less than 90 degree by forming a slit-cut in the sheet metal connector by means of a die, which progressively at the same station, forms a fastener guideway in the shape of a half cone. The fastener opening and the guideway are dimensioned so that the fastener can only penetrate the sheet metal connector at a preselected angle set at the factory.

Applicant believes that another reference corresponds to U.S. Pat. No. 4,602,468 A issued to Harold Simpson on Jul. 29, 1986 for Roof clip assembly for a roof system. However, it differs from the present invention because Simpson teaches an improved building assembly in which a flexible membrane is employed as a stabilization element for secondary structural members. The building assembly is also provided with a plurality of tertiary support assemblies and an improved bracing system for selected tertiary support assemblies to minimize or prevent failures of the tertiary structural assemblies due to the translational and rotational movement of the tertiary structural assemblies as a load is applied thereto, while at the same time other tertiary structural assemblies connected to other elements of the roof move in unison with the roof as the roof changes shape because if expansion and contraction or other forces. An improved roof structural bracing system for interconnecting the wall of the building via a wall connector to a primary support beam so as to minimize or prevent failures of the wall connector due to translational and rotational movement of the wall connector as a load is applied thereto.

Applicant believes that another reference corresponds to U.S. Pat. No. 1,578,947 A issued to Walter Alber on Apr. 24, 1926 for Anchor. However, it differs from the present invention because Alber teaches anchors and certain more specific features to anchors for sleepers or studding, which abut against concrete.

Applicant believes that another reference corresponds to U.S. Pat. No. 1,406,723 A issued to Caldwell on Feb. 14, 1922 for Roof clip assembly for a roof system. However, it differs from the present invention because Caldwell teaches a positive fastener-angling device for positioning an elongated fastener with respect to the face of a sheet metal connector and a wood member only at a preselected angle which is substantially less than 90 degree by forming a slit-cut in the sheet metal connector by means of a die, which progressively at the same station, forms a fastener guideway in the shape of a half cone. The fastener opening and the guideway are dimensioned so that the fastener can only penetrate the sheet metal connector at a preselected angle set at the factory.

Other patents describing the closest subject matter provide for a number of more or less complicated features that fail to solve the problem in an efficient and economical way. None of these patents suggest the novel features of the present invention.

SUMMARY OF THE INVENTION

The present invention is a member to structural member connector, comprising a strap assembly having first and second lateral sides, and a top side; and a fastening assembly, wherein the strap assembly secures at least one member to a fixed structure, wherein the strap assembly wraps over the at least one member and the first and second lateral sides are fixed to the fixed structure by the fastening assembly.

The first lateral side comprises a first top edge and a first bottom end. The second lateral side comprises a second top edge and a second bottom end. The first lateral side comprises a first hole that is a first predetermined distance from the first bottom end. The second lateral side comprises a second hole that is a second predetermined distance from the second bottom end. The top side is in between the first and second top edges. The top side comprises a top hole. The first and second lateral sides are substantially straight and define a predetermined angle in a preinstalled configuration. The predetermined angle is variable but less than 90 degrees.

The fastening assembly comprises first and second fasteners and first and second washers. The top hole receives a top fastener to fix the top side to the at least one member. The first and second holes receive first and second fasteners respectively to fix the first and second lateral sides to the fixed structure. The first and second washers are positioned in between the first and second fasteners and the first and second lateral sides respectively.

A predetermined force is created by the first and second fasteners and the first and second washers respectively to secure the first and second fasteners into the fixed structure, whereby the first and second lateral sides bend by the predetermined force causing strain, and stretching the strap assembly to define respective base sections and causing a compression force, which keeps the at least one member substantially attached and secured to the fixed structure. The strap assembly when stretched comprises a tension force holding the structural members according to a design capacity. The at least one member can be a structural member of a roof frame.

A method to install a member to a structural member connector, comprising the following steps:

A) selecting a strap assembly according to a dimension of at least one member;

B) wrapping the strap assembly over the at least one member;

C) fixing a top side of strap assembly onto the at least one member;

D) correcting an angle between first and second lateral sides of the strap assembly less than 90 degrees, wherein the first and second lateral sides are substantially straight;

E) fixing the first and second lateral sides onto a fixed structure, specifically onto a structural member, with first and second fasteners; and F) placing a predetermined force onto the first and second fasteners and first and second washers respectively to secure the first and second fasteners into the fixed structure, whereby the first and second lateral sides bend by the predetermined force causing strain, and stretching strap assembly to define respective base sections and causing a compression force, which keeps the at least one member substantially attached and secured to the fixed structure.

It is therefore one of the main objects of the present invention to provide a member to structural member connector.

It is another object of this invention to provide a member to structural member connector, which secures at least one member to a fixed structure.

It is another object of this invention to provide a member to structural member connector that has straight lateral sides, which bend during installation.

It is another object of this invention to provide a member to structural member connector, which has a variety of sizes, forms, and materials.

It is another object of this invention to provide a member to structural member connector that is volumetrically efficient for carrying, transporting, and storage.

It is another object of this invention to provide a member to structural member connector that can be readily assembled and disassembled without the need of any special tools.

It is another object of this invention to provide a member to structural member connector, which is of a durable and reliable construction.

It is yet another object of this invention to provide such a device that is inexpensive to manufacture and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE PREFERRED EMBODIMENT

Figure 1:
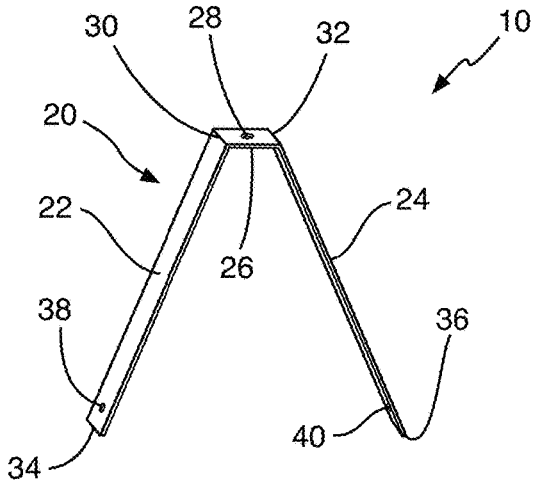
FIG. 1 is an isometric view of the present invention in a preinstalled configuration.

Referring now to the drawings, the present invention is a member to structural member connector, and is generally referred to with numeral 10. It can be observed that it basically includes strap assembly 20 and fastening assembly 60.

Figure 2:
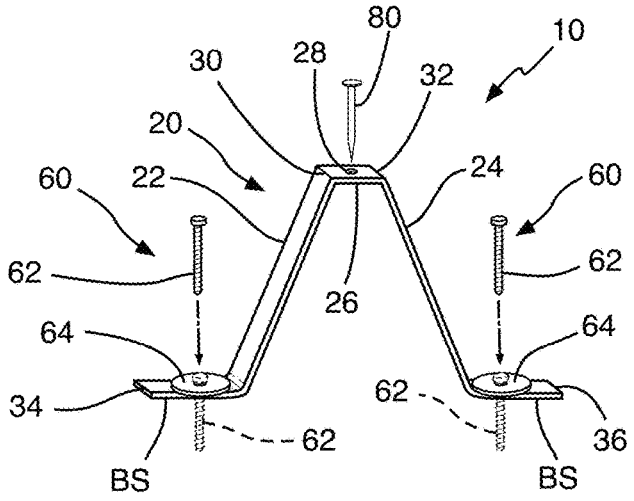
FIG. 2 is an isometric view of the present in an installed configuration.

As seen in FIGS. 1 and 2, strap assembly 20 comprises first lateral side 22, second lateral side 24, and top side 26.

Lateral side 22 comprises top edge 30 and bottom end 34. Lateral side 24 comprises top edge 32 and bottom end 36. Lateral side 22 comprises hole 38 that is a first predetermined distance from bottom end 34, and lateral side 24 comprises hole 40 that is a second predetermined distance from bottom end 36. In a preferred embodiment, the first and second predetermined distances are the same. Top side 26 comprises top hole 28, and is in between first top edge 30 and second top edge 32. First and second lateral sides 22 and 24 respectively define a predetermined angle. In a preferred embodiment, the predetermined angle is less than 90 degrees. As illustrated in FIG. 1, first and second lateral sides 22 and 24 respectively are substantially straight in a preinstalled configuration.

As seen in FIG. 2, fastening assembly 60 comprises fasteners 62 and washers 64. For illustrative purposes, present invention 10 is an installed configuration, whereby first and second lateral sides 22 and 24 have been bent by a predetermined force placed upon fasteners 62 and washers 64, to define respective base sections BS.

Figure 3:
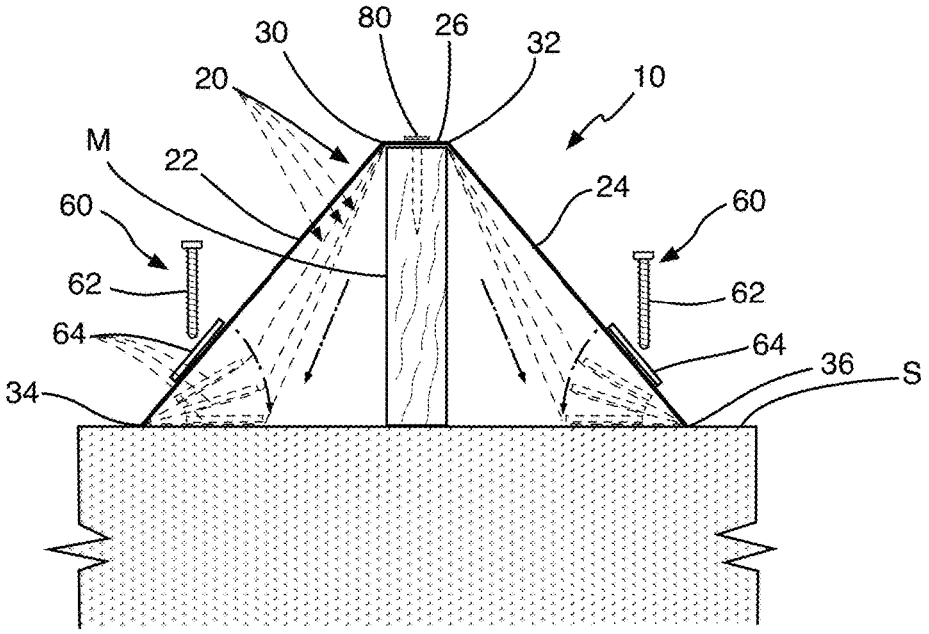
FIG. 3 is a front view of the present invention in the preinstalled configuration ready for installation to illustrate a process of a step-by-step installation procedure.

As seen in FIGS. 2 and 3, top hole 28 receives top fastener 80 to fix top side 26 to at least one member M. First and second holes 38 and 40, seen in FIG. 1, receive first and second fasteners 62 respectively to fix first and second lateral sides 22 and 24 to fixed structure S. Washers 64 are positioned between fasteners 62 and respective first and second lateral sides 22 and 24.

Figure 4:
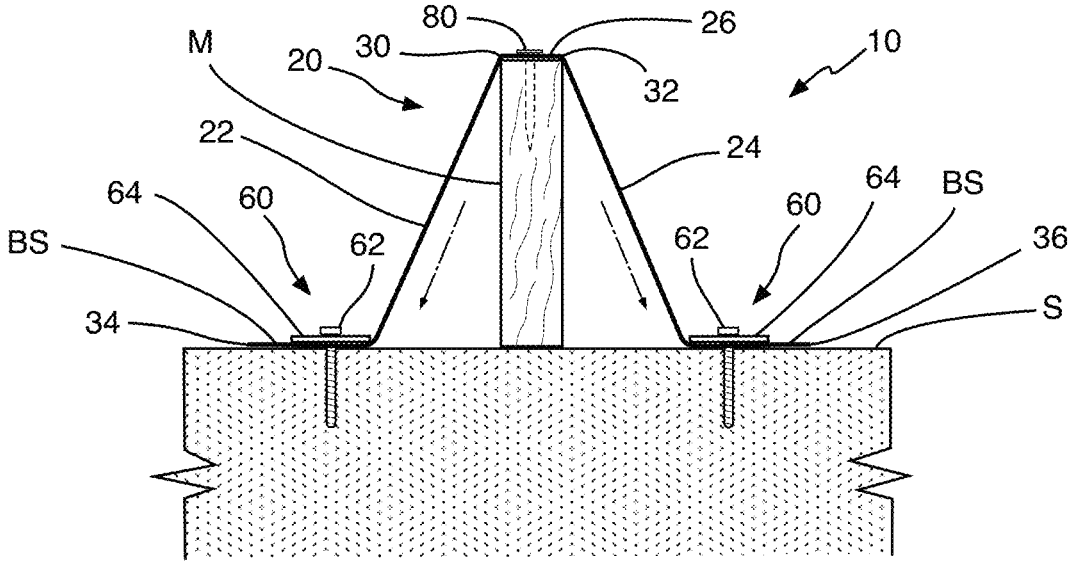
FIG. 4 is a front view of the present invention in the installed configuration after installation.

As seen in FIGS. 3 and 4, strap assembly 20 secures at least one member M to fixed structure S, whereby strap assembly 20 wraps over at least one member M. Top hole 28 receives top fastener 80 to fix top side 26 onto at least one member M, and first and second lateral sides 22 and 24 are fixed to fixed structure S by fastening assembly 60, whereby first and second lateral sides 22 and 24 have been bent by a predetermined force placed upon fasteners 62 and washers 64, to define respective base sections BS. A length of strap assembly 20 is variable allowing several sizes according to dimensions of member M.

Figure 5:
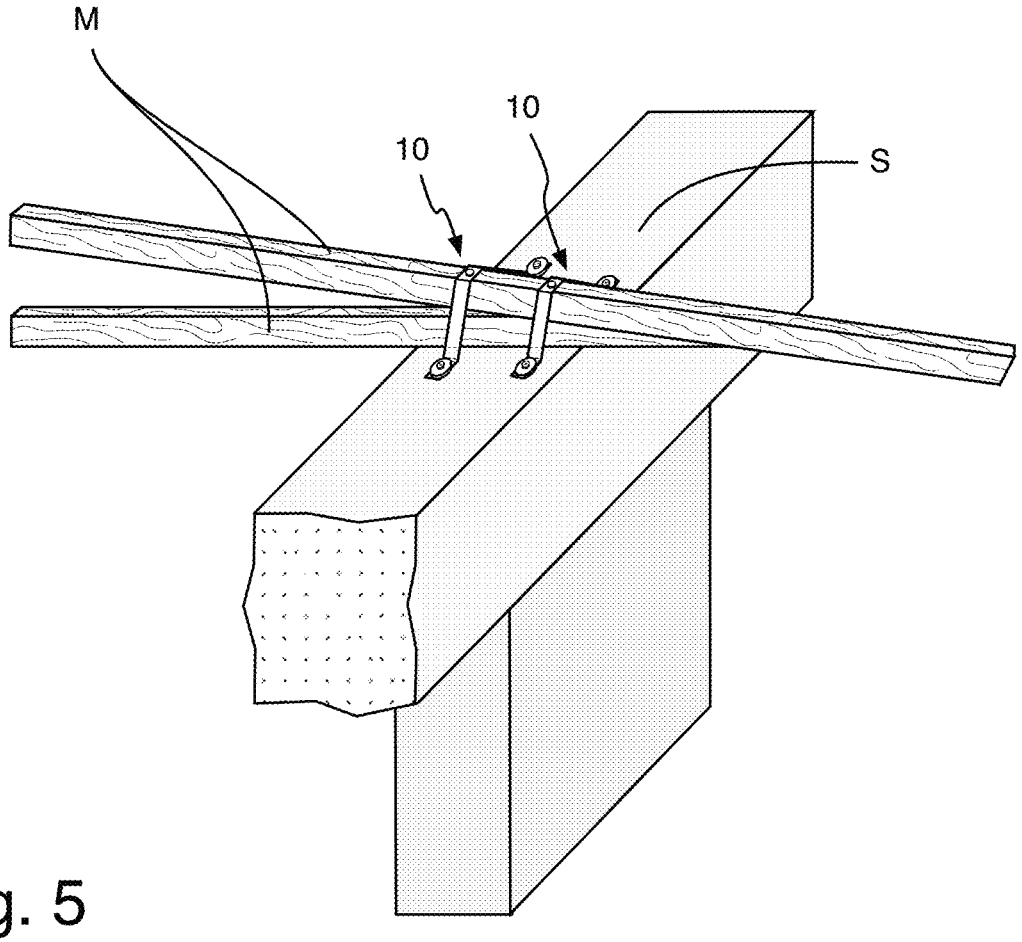
FIG. 5 is an isometric view of the present invention in the installed configuration after installation and securing two members onto a structural member.

As seen in FIGS. 4 and 5, first and second washers 64 bend first and second lateral sides 22 and 24 causing strain, and stretching strap assembly 20. Strap assembly 20 is stretched with first and second fastening means 60 causing a compression force, which keeps at least one member M substantially attached and secured to fixed structure S. More specifically, a predetermined force is placed onto first and second fasteners 62 and first and second washers 64 respectively to secure first and second fasteners 62 into fixed structure S, whereby first and second lateral sides 22 and 24 bend by said predetermined force causing strain, and stretching strap assembly 20 to define respective base sections BS and causing a compression force, which keeps at least one member M substantially attached and secured to fixed structure S.

Strap assembly when stretched comprises a tension force holding the structural members according to the design capacity. In a preferred embodiment, the at least one member M is a structural member of a roof, and the fixed structure S is a beam.

In a preferred embodiment, a method to install a member to a structural member connector according to present invention 10, comprises the following steps:

A) selecting a strap assembly 20 according to a dimension of at least one member M;

B) wrapping said strap assembly 20 over said at least one member M;

C) fixing a top side 26 of strap assembly 20 onto said at least one member M;

D) correcting an angle between first and second lateral sides 22 and 24 of said strap assembly 20 less than 90 degrees, wherein said first and second lateral sides 22 and 24 are substantially straight;

E) fixing said first and second lateral sides 22 and 24 onto a fixed structure S, specifically onto a beam, with first and second fasteners 62; and F) placing a predetermined force onto said first and second fasteners 62 and first and second washers 64 respectively to secure said first and second fasteners 62 into said fixed structure S, whereby said first and second lateral sides 22 and 24 bend by said predetermined force causing strain, and stretching strap assembly 20 to define respective base sections BS and causing a compression force, which keeps said at least one member M substantially attached and secured to said fixed structure S.

Present invention 10 may be used to connect at least one wood member M to a wood fixed structure S or to a concrete fixed structure S.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A member to structural member connector, comprising:

A) a strap assembly having first and second lateral sides, and a top side defining an upmost planar surface, said upmost planar surface having first and second edges, wherein said first and second lateral sides diverge away from respective said first and second edges of said upmost planar surface at an angle of less than 90 degrees, said first lateral side comprises a first top edge, a first bottom end, and a first hole that is a first predetermined distance from said first bottom end, said second lateral side comprises a second top edge, a second bottom end, and a second hole that is a second predetermined distance from said second bottom end, said first and second lateral sides are entirely planar and define a substantially triangular shape and a predetermined angle, wherein said predetermined angle is less than 90 degrees; and B) a fastening assembly, comprising first and second fasteners and first and second washers; and C) wherein said strap assembly is configured to wrap over said at least one member, whereby said first and second lateral sides are fixed to said fixed structure with said fastening assembly when a predetermined force is placed onto said first and second fasteners and said first and second washers respectively to secure said first and second fasteners into said fixed structure, whereby said first and second lateral sides are configured to bend by said predetermined force to define respective base sections, whereby, when bent, said base sections are parallel to said fixed structure and define an obtuse angle with respect to corresponding said first and second lateral sides, said first and second holes receive said first and second fasteners respectively for fixing said first and second lateral sides to said fixed structure, said predetermined force is configured to cause strain, and stretching said strap assembly to define respective said base sections and is configured to cause a compression force, which is adapted to keep said at least one member substantially attached and secured to said fixed structure.

2. The member to structural member connector set forth in claim 1, wherein said top side is in between said first and second top edges.

3. The member to structural member connector set forth in claim 1, wherein said top side comprises a top hole.

4. The member to structural member connector set forth in claim 3, wherein said top hole receives an anchor to fix said top side to said at least one member.

5. The member to structural member connector set forth in claim 1, wherein said first and second washers are positioned in between said first and second fasteners and said first and second lateral sides respectively.

6. The member to structural member connector set forth in claim 1, wherein said strap assembly when stretched comprises a tension force holding structural members according to a design capacity.

7. The member to structural member connector set forth in claim 1, wherein said at least one member is a structural member of a roof.

* * * * *